US006217015B1

(12) United States Patent
Kulla

(10) Patent No.: US 6,217,015 B1
(45) Date of Patent: Apr. 17, 2001

(54) GLASS BLOCK INSTALLATION TOOL

(76) Inventor: Paul Kulla, 105 Deer Run Rd., Washington, PA (US) 15301

( * ) Notice: Subject to any disclaimer, the term of this patent is extended or adjusted under 35 U.S.C. 154(b) by 0 days.

(21) Appl. No.: 09/349,811

(22) Filed: Jul. 8, 1999

(51) Int. Cl.[7] ..... B23Q 3/00
(52) U.S. Cl. ..... 269/296; 269/208; 269/904
(58) Field of Search ..... 269/97, 296, 289 R, 269/208, 404; 254/133 A, 134, 98, 100, DIG. 1, DIG. 4; 248/354.5

(56) References Cited

U.S. PATENT DOCUMENTS 2,594,605 * 4/1952 Zoppelt ..... 254/98
2,906,490 * 9/1959 Russell ..... 248/354.5
3,398,933 * 8/1968 Haroldson ..... 254/98
4,221,362 * 9/1980 Van Santen ..... 254/133 A
5,201,488 * 4/1993 Hadbavny ..... 248/354.5

* cited by examiner

*Primary Examiner*—Robert C. Watson

(57) ABSTRACT

A glass block installation tool for preventing glass block from falling out of a window frame during installation. The glass block installation tool includes an elongate tubular sleeve. An elongate arm member has a first flange coupled to one end thereof that is adapted for engaging a window sill. The other end of the first arm member is telescopically inserted in the sleeve. The sleeve is positionable along the arm member. An adjustment member has a second flange extending from an outer end thereof and adapted for engaging a window sill. The adjustment member is threaded from a second end thereof towards the second flange. The second end of the adjustment member is slidably insertable in the sleeve opposite the arm member. A nut threadably engages the adjustment member and is positioned between the sleeve and the second flange.

6 Claims, 3 Drawing Sheets

GLASS BLOCK INSTALLATION TOOL

BACKGROUND OF THE INVENTION

1. Field of the Invention

The present invention relates to window installation devices and more particularly pertains to a new glass block installation tool for preventing glass block from falling out of a window frame during installation.

2. Description of the Prior Art

The use of window installation devices is known in the prior art. More specifically, window installation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,019,765; U.S. Pat. No. 4,737,056; U.S. Pat. No. 5,281,063; U.S. Pat. No. 3,802,690; U.S. Pat. No. 2,263,698; and U.S. Pat. No. Des. 255,212.

While these devices fulfill their respective, particular objectives and requirements, the aforementioned patents do not disclose a new glass block installation tool. The inventive device includes an elongate tubular sleeve. An elongate arm member has a first flange coupled to one end thereof that is adapted for engaging a window sill. The other end of the first arm member is telescopically inserted in the sleeve. The sleeve is positionable along the arm member. An adjustment member has a second flange extending from an outer end thereof and adapted for engaging a window sill. The adjustment member is threaded from a second end thereof towards the second flange. The second end of the adjustment member is slidably insertable in the sleeve opposite the arm member. A nut threadably engages the adjustment member and is positioned between the sleeve and the second flange.

In these respects, the glass block installation tool according to the present invention substantially departs from the conventional concepts and designs of the prior art, and in so doing provides an apparatus primarily developed for the purpose of preventing glass block from falling out of a window frame during installation.

SUMMARY OF THE INVENTION

In view of the foregoing disadvantages inherent in the known types of window installation devices now present in the prior art, the present invention provides a new glass block installation tool construction wherein the same can be utilized for preventing glass block from falling out of a window frame during installation.

The general purpose of the present invention, which will be described subsequently in greater detail, is to provide a new glass block installation tool apparatus and method which has many of the advantages of the window installation devices mentioned heretofore and many novel features that result in a new glass block installation tool which is not anticipated, rendered obvious, suggested, or even implied by any of the prior art window installation devices, either alone or in any combination thereof.

To attain this, the present invention generally comprises an elongate tubular sleeve. An elongate arm member has a first flange coupled to one end thereof that is adapted for engaging a window sill. The other end of the first arm member is telescopically inserted in the sleeve. The sleeve is positionable along the arm member. An adjustment member has a second flange extending from an outer end thereof and adapted for engaging a window sill. The adjustment member is threaded from a second end thereof towards the second flange. The second end of the adjustment member is slidably insertable in the sleeve opposite the arm member. A nut threadably engages the adjustment member and is positioned between the sleeve and the second flange.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new glass block installation tool apparatus and method which has many of the advantages of the window installation devices mentioned heretofore and many novel features that result in a new glass block installation tool which is not anticipated, rendered obvious, suggested, or even implied by any of the prior art window installation devices, either alone or in any combination thereof.

It is another object of the present invention to provide a new glass block installation tool which may be easily and efficiently manufactured and marketed.

It is a further object of the present invention to provide a new glass block installation tool which is of a durable and reliable construction.

An even further object of the present invention is to provide a new glass block installation tool which is susceptible of a low cost of manufacture with regard to both materials and labor, and which accordingly is then susceptible of low prices of sale to the consuming public, thereby making such glass block installation tool economically available to the buying public.

Still yet another object of the present invention is to provide a new glass block installation tool which provides in the apparatuses and methods of the prior art some of the advantages thereof, while simultaneously overcoming some of the disadvantages normally associated therewith.

Still another object of the present invention is to provide a new glass block installation tool for preventing glass block from falling out of a window frame during installation.

Yet another object of the present invention is to provide a new glass block installation tool which includes an elongate tubular sleeve. An elongate arm member has a first flange coupled to one end thereof that is adapted for engaging a window sill. The other end of the first arm member is telescopically inserted in the sleeve. The sleeve is positionable along the arm member. An adjustment member has a second flange extending from an outer end thereof and adapted for engaging a window sill. The adjustment member is threaded from a second end thereof towards the second flange. The second end of the adjustment member is slidably insertable in the sleeve opposite the arm member. A nut threadably engages the adjustment member and is positioned between the sleeve and the second flange.

Still yet another object of the present invention is to provide a new glass block installation tool that eliminates the need for two persons to install glass block.

Even still yet another object of the present invention is to provide a new glass block installation tool that increases accuracy during installation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
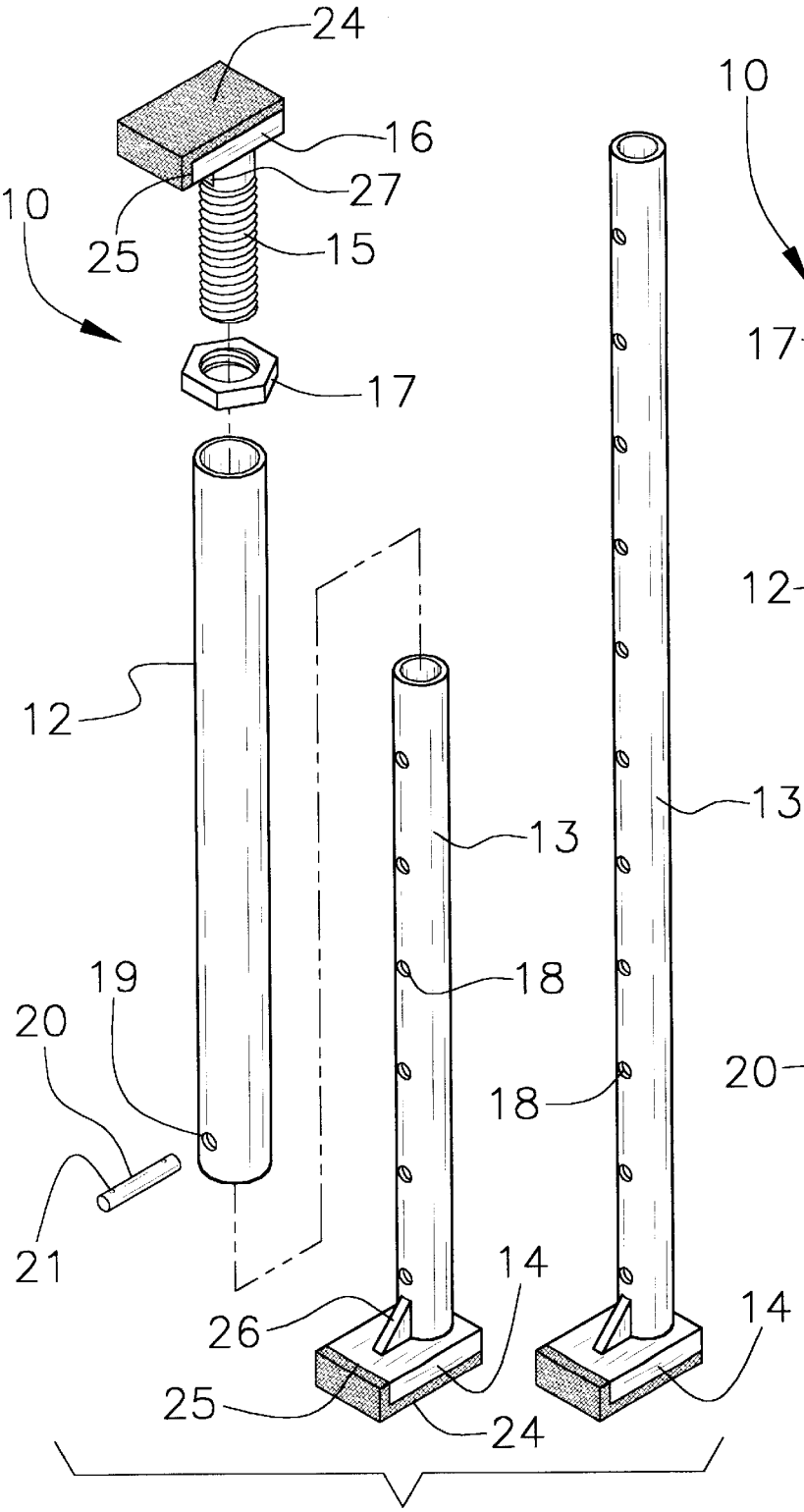
FIG. 1 is a schematic perspective exploded view of a new glass block installation tool according to the present invention.
Figure 2:
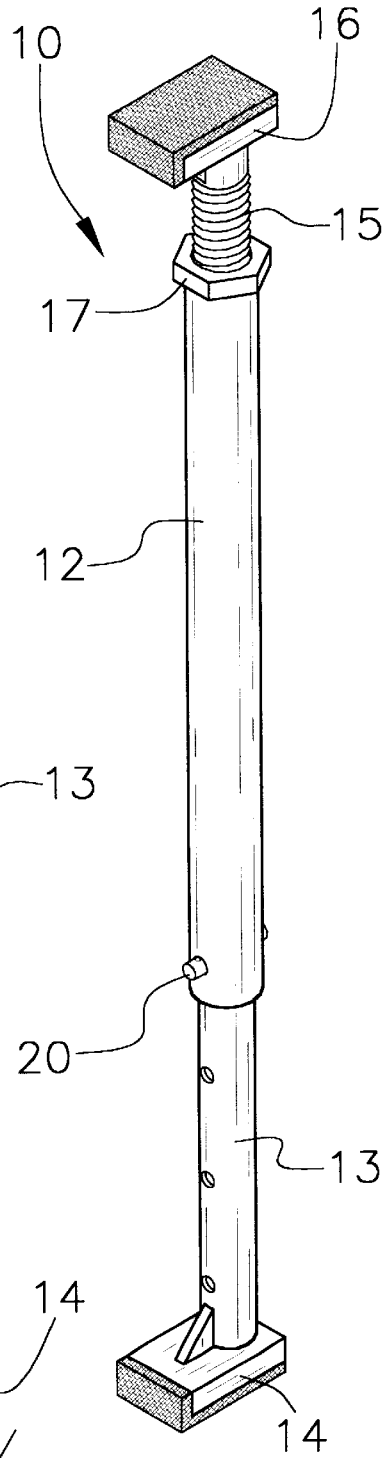
FIG. 2 is a schematic perspective view of the present invention.
Figure 3:
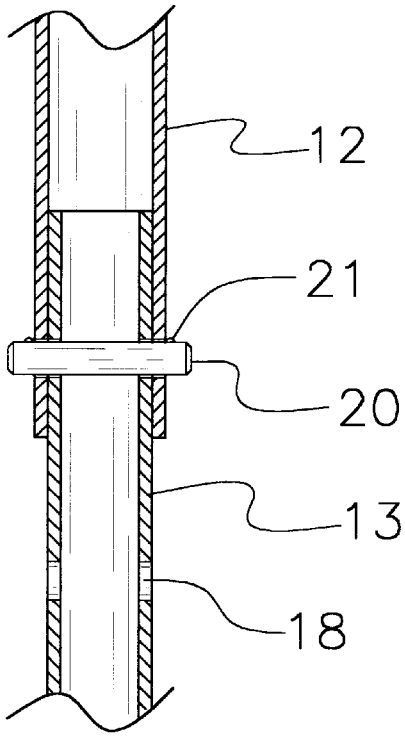
FIG. 3 is a schematic partial cross sectional view of the present invention.

With reference now to the drawings, and in particular to FIGS. 1 through 5 thereof, a new glass block installation tool embodying the principles and concepts of the present invention and generally designated by the reference numeral 10 will be described.

As best illustrated in FIGS. 1 through 5, the glass block installation tool 10 generally comprises an elongate tubular sleeve 12. An elongate arm member 13 has a first flange 14 coupled to one end thereof that is adapted for engaging a window sill 1. The other end of the first arm member is telescopically inserted in the sleeve. The sleeve is positionable along the arm member. An adjustment member 15 has a second flange 16 extending from an outer end thereof and adapted for engaging a window sill. The adjustment member is threaded from a second end thereof towards the second flange. The second end of the adjustment member is slidably insertable in the sleeve opposite the arm member. A nut 17 threadably engages the adjustment member and is positioned between the sleeve and the second flange.

Preferably, the arm member has a plurality of apertures 18 through it. The sleeve has a pair of holes 19 through it. A pin 20 is slidably inserted through the holes of the sleeve and through a pair of apertures of the arm member to prevent movement of the extension arm with respect to the sleeve. Ideally, the pin has a pair of spheres 21 protruding therefrom that are biased outwardly to prevent the pin from sliding out of the sleeve.

Preferably, the first flange has an outer portion 22 extending laterally therefrom. The second flange has an outer portion 23 extending laterally therefrom.

Also preferably, the first and second flanges each have a resiliently deformable pad 24 coupled to an outer face thereof. Ideally, the pads extend around outer edges 25 of the outer portions of the flanges so that the flanges don't scratch glass blocks resting on their outer edges. See FIG. 4.

Ideally, a first triangular support portion 26 is coupled to the arm member and the first flange. A second triangular support portion 27 is coupled to the support portion and the second flange. The support portions help prevent bending of the outer portions of the flanges.

Preferably, two arm members of different lengths are provided, as shown in FIG. 1. The preferred longitudinal length of one of the arm members is about 12 inches, while the preferred longitudinal length of the other arm member is about 22 inches. The preferred longitudinal length of the sleeve is about 12 inches. The preferred longitudinal length of the extension portion is about 3 inches.

Figure 4:
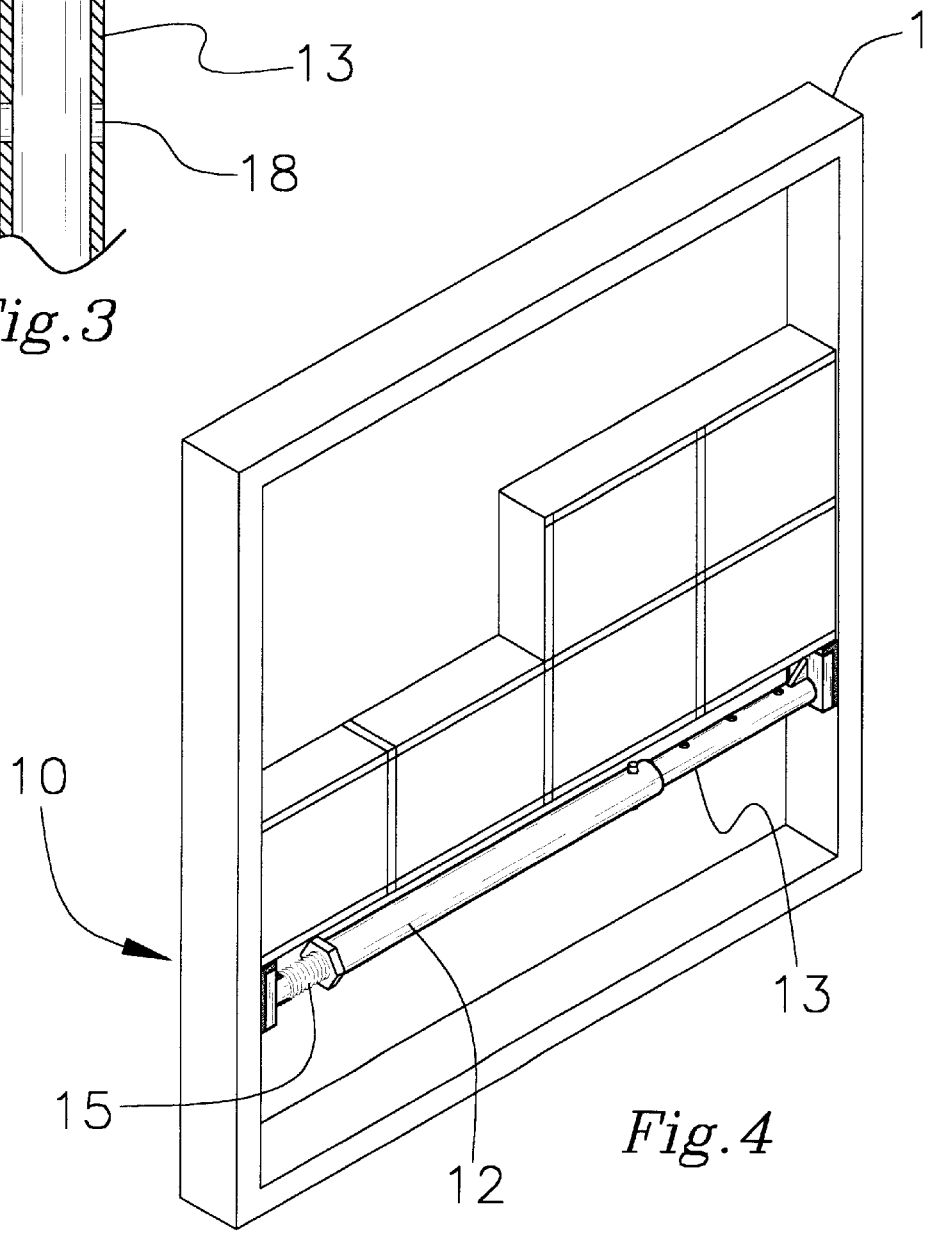
FIG. 4 is a schematic perspective view of the present invention in use.
Figure 5:
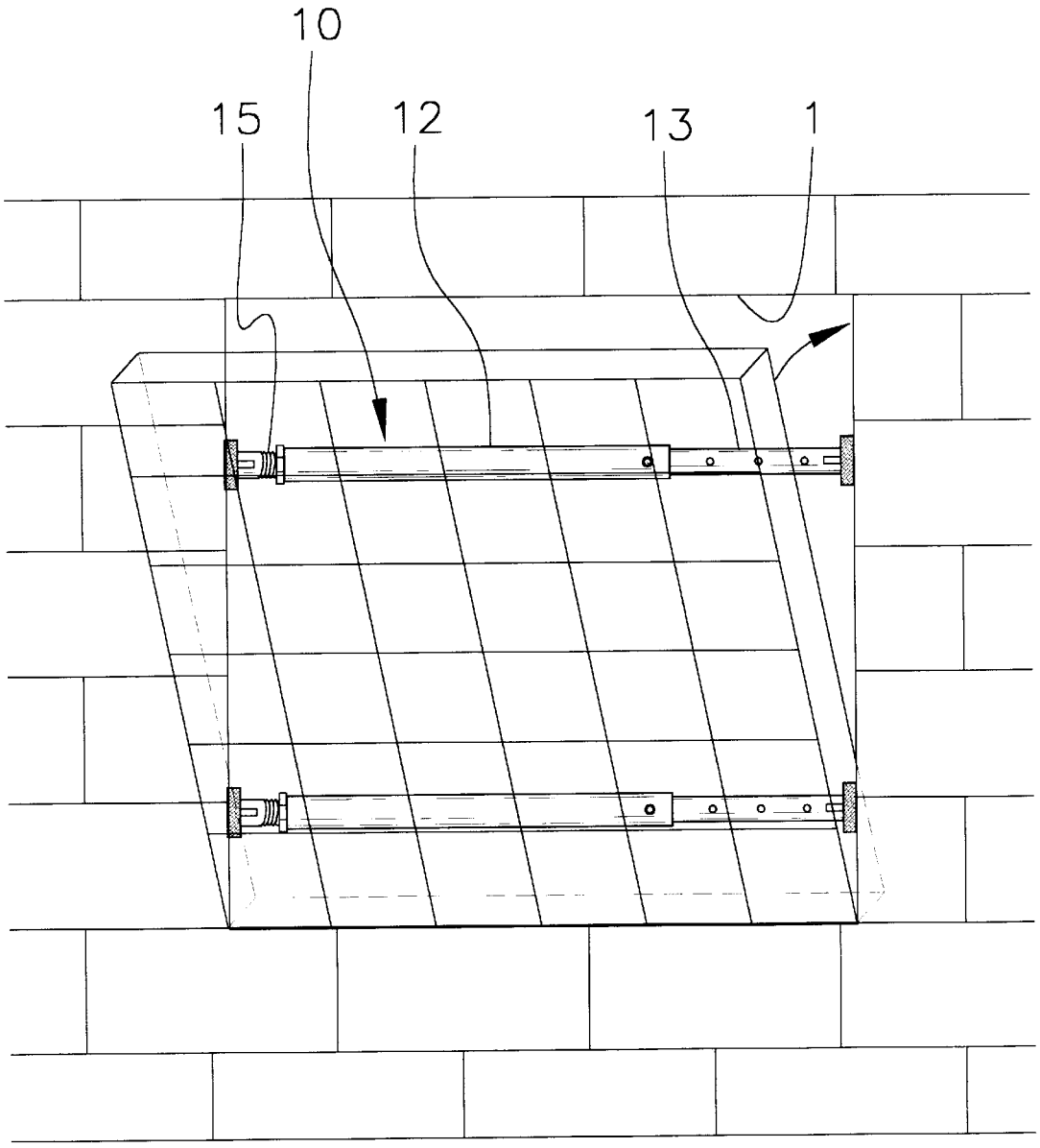
FIG. 5 is a schematic perspective view of the present invention in use when installing a preassembled glass block window.

In use, the extension arm is extended from the sleeve to the desired position. The tool is positioned towards an outer edge of a window sill and the nut is rotated to tighten the flanges against the window sill. Glass blocks are positioned in the window sill. The tool prevents the blocks from falling through the back of the window sill. The same procedure is used to insert a preassembled glass block window in the sill. The tool may also be used to support glass blocks above the bottom of the sill, as shown in FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for supporting glass block when installing the glass block in a window sill, the tool comprising:

an elongate tubular sleeve;

an elongate arm member adapted for engaging a window sill, a first flange coupled to one end of said arm member for engaging a first portion of a window sill, the other end of said first arm member being telescopically inserted in said sleeve, said sleeve being positionable along said arm member;

an adjustment member adapted for engaging a window sill, a second flange extending from an outer end of said adjustment member for engaging a window sill, said adjustment member being threaded from a second end thereof towards said second flange, said second end of said adjustment member being slidably insertable in said sleeve opposite said arm member; and a nut threadably engaging said adjustment member and being removably positioned between said sleeve and said second flange such that the position of said nut on said adjustment member limits the insertion of said adjustment member into said sleeve, said nut being free of said sleeve, such that said adjustment member is slidable out of said sleeve without rotating said nut for permitting sliding adjustment of a length of said sleeve and said adjustment member to a distance between portions of a window sill;

wherein said arm member has a plurality of apertures therethrough, said sleeve having a pair of holes therethrough a pin slidably inserted through said holes of said sleeve and through a pair of apertures of said arm member, said pin having a pair of spheres protruding therefrom, said spheres being outwardly biased for preventing the pin from sliding out of the sleeve.

2. A tool for supporting glass block when installing the glass block in a window sill, the tool comprising:

an elongate tubular sleeve;

an elongate arm member adapted for engaging a window sill, a first flange coupled to one end of said arm member for engaging a first portion of a window sill, the other end of said first arm member being telescopically inserted in said sleeve, said sleeve being positionable along said arm member;

an adjustment member adapted for engaging a window sill, a second flange extending from an outer end of said adjustment member for engaging a window sill, said adjustment member being threaded from a second end thereof towards said second flange, said second end of said adjustment member being slidably insertable in said sleeve opposite said arm member; and a nut threadably engaging said adjustment member and being removably positioned between said sleeve and said second flange such that the position of said nut on said adjustment member limits the insertion of said adjustment member into said sleeve, said nut being free of said sleeve, such that said adjustment member is slidable out of said sleeve without rotating said nut for permitting sliding adjustment of a length of said sleeve and said adjustment member to a distance between portions of a window sill;

wherein said first and second flanges each having a resiliently deformable pad coupled to an outer face thereof, each pad having a first surface perpendicular to an axis for abutting a frame of the window, each pad having a second surface oriented perpendicularly to said first surface for abutting against a glass window block.

3. The tool of claim 2, further comprising a first triangular support portion coupled to said arm member and said first flange, a second triangular support portion being coupled to said adjustment portion and said second flange.

4. A tool for supporting glass block when installing the glass block in a window sill, the tool comprising:

an elongate tubular sleeve;

an elongate arm member having a first flange coupled to one end thereof and adapted for engaging a window sill, the other end of said arm member being telescopically inserted in said sleeve, said sleeve being positionable along said arm member;

an adjustment member having a second flange extending from an outer end thereof and adapted for engaging a window sill, said adjustment member being threaded from a second end thereof towards said second flange, said second end of said adjustment member being slidably insertable in said sleeve opposite the arm member;

a nut threadably engaging said adjustment member and being removably positioned between said sleeve and said second flange, said nut being rotatable with respect to the sleeve such that said adjustment member may be extended from the sleeve wholly by movement of the nut;

said arm member having a plurality of apertures therethrough, said sleeve having a pair of holes therethrough, a pin slidably inserted through said holes of said sleeve and through a pair of apertures of said arm member, said pin having a pair of spheres protruding therefrom, said spheres being outwardly biased for preventing the pin from sliding out of the sleeve;

said first flange having an outer portion extending laterally therefrom;

said second flange having an outer portion extending laterally therefrom;

said first and second flanges each having a resiliently deformable pad coupled to an outer face thereof, each pad having a first surface lying in a plane oriented perpendicular to an axis for abutting a portion of the window sill, each pad having a second surface oriented perpendicular to said first surface for abutting against a glass window block positioned adjacent to said window sill such that the flanges do not scratch glass blocks in the window sill;

a first triangular support portion coupled to said arm member and said first flange; and a second triangular support portion coupled to said support portion and said second flange.

5. The tool of claim 4, wherein said sleeve has a longitudinal length of about 12 inches.

6. The tool of claim 4, wherein said adjustment member has a longitudinal length of about 3 inches.

* * * * *